US005146234A

United States Patent [19]

Lalezari

[11] Patent Number: 5,146,234

[45] Date of Patent: Sep. 8, 1992

[54] DUAL POLARIZED SPIRAL ANTENNA

[75] Inventor: Farzin Lalezari, Louisville, Colo.

[73] Assignee: Ball Corporation, Muncie, Ind.

[21] Appl. No.: 404,676

[22] Filed: Sep. 8, 1989

[51] Int. Cl.[5] ..... H01Q 1/36; H01Q 9/27; H01Q 21/00

[52] U.S. Cl. ..... 343/895; 343/859

[58] Field of Search ..... 343/895, 859

[56] References Cited

U.S. PATENT DOCUMENTS

| | | | |
|---|---|---|---|
| 2,977,594 | 3/1961 | Marston | 343/756 |
| 3,015,101 | 12/1961 | Turner et al. | 343/848 |
| 3,017,633 | 1/1962 | Marston et al. | 343/895 |
| 3,034,121 | 5/1962 | Riblet | 343/770 |
| 3,144,648 | 8/1964 | Dollinger | 343/895 |
| 3,366,963 | 1/1968 | Goff | 343/741 |
| 3,509,465 | 4/1970 | Andre et al. | 325/373 |
| 3,656,168 | 4/1972 | Stropki | 343/895 |
| 3,735,409 | 5/1973 | Gershberg et al. | 343/895 |
| 3,942,180 | 3/1976 | Rannou et al. | 343/895 |
| 3,969,732 | 7/1976 | Holloway | 343/895 |
| 4,525,720 | 6/1985 | Corzine et al. | 343/895 |
| 4,658,262 | 4/1987 | DuHamel | 343/792.5 |
| 4,780,727 | 10/1988 | Seal et al. | 343/895 |
| 4,823,145 | 4/1989 | Mayes et al. | 343/895 |
| 4,843,404 | 6/1989 | Benge et al. | 343/895 |

FOREIGN PATENT DOCUMENTS 2174249 10/1986 United Kingdom .

OTHER PUBLICATIONS

Chu, et al., "The Sinuous Antenna", Jun. 1988, pp. 40–48, MSN & CT.

*Primary Examiner*—Michael C. Wimer
*Attorney, Agent, or Firm*—Gilbert E. Alberding

[57] ABSTRACT

A broadband dual polarized antenna includes pairs of electrically separated stacked spiral antenna arms. Each pair of spiral arms have opposite senses and are orthogonal to each other. The relative overlap of each pair of spirals is kept to a minimum so that radiation received and transmitted by the bottom pair of spiral arms will be degraded as little as possible. No overlap exists within each pair of spiral arms, and the pair need not be co-planar, but do share a common axis with the other pair of spiral arms. The spiral arms can be segmented or may comprise a number of spiralling wire elements. A plurality of such antenna structures can be formed into an array capable of beam shaping or scanning.

16 Claims, 10 Drawing Sheets

DUAL POLARIZED SPIRAL ANTENNA

BACKGROUND OF THE INVENTION

1. Field of the Invention

The present invention is related to antennas, and more particularly, to broadband dual polarized antennas composed of oppositely sensed spiral metallizations.

2. Description Of The Related Art

Due to the unprecedented variety of electromagnetic signals in use today, a need has arisen for a single, broadband antenna that will transmit and receive many signals, including not only vertically and horizontally polarized signals, but right-hand and left-hand circularly polarized signals. The need for such antennas is especially strong in applications where size is also an important consideration. Size is an important factor for antennas mounted on mobile platforms, such as aircraft and the like. At the same time, such antennas must not interfere with the aerodynamics of the mobile airborne platform and, for airborne platforms associated with military or security objectives, such antennas must have low observability characteristics.

The sinuous antenna has been proposed as a solution to these requirements. The sinuous antenna is planar, broadband and dual polarized from a single aperture. However, the sinuous antenna has several drawbacks, not the least of which is that it is difficult to construct. The sinuous antenna includes at least four separate antenna arms on its planar surface. The antenna arms radiate out in identical sinuous patterns symmetrically about a center point. The antenna arms cannot contact each other, and each antenna arm must be center fed independently of the others. Given the close proximity of the centers of the arms, the design does not lend itself to low cost manufacturing schemes. This is further complicated by the fact that the ability of such antennas to receive or transmit high frequency signals is determined by the accuracy of the antenna arms near the center of the antenna. Accordingly, as high accuracy is required of the centers of the separate antenna arms, and each antenna arm must be center fed, construction constraints necessarily either diminish the high end abilities of sinuous antennas and/or make construction of sinuous antennas more difficult and costly.

Further, sinuous antennas need additional circuitry, in the form of a hybrid circuit connected to the center feeds, to receive right-hand and left-hand circularly polarized signals. This additional hardware adds to the cost of the antenna, and requires additional manufacturing steps. Therefore, while theoretically effective, the sinuous antenna is complex and difficult to construct.

SUMMARY OF THE INVENTION

Accordingly, an object of the present invention is to provide a simplified dual polarized broadband antenna.

A further object of the present invention is to provide a dual polarized broadband antenna which is easy to manufacture.

Another object of the present invention is to provide a dual polarized broadband antenna having a simplified feed structure.

Yet another object of the present invention is to provide a dual polarized broadband antenna for use with airborne platforms.

A further object of the present invention is to provide an antenna which will not interfere with the aerodynamics of an aircraft and have low observability characteristics.

Other objects and advantages of the present invention will be set forth in part in the description and drawings which follow, and, in part, will be obvious from the description, or may be learned by practice of the invention.

To achieve the foregoing objects and in accordance with the purpose of the invention, as embodied and broadly described herein, an antenna according to the present invention comprises: a first spiral antenna arm having a 45° spiral angle; and a second spiral antenna arm having a −45° spiral angle, the second spiral antenna arm being coaxial with and separated from the first spiral antenna arm.

Preferably, the first and second spiral antenna arms are formed on at least one sheet of dielectric material, and the first and second spiral antenna arms may comprise segmented spiral strips. Alternatively, the first and second spiral antenna arms may comprise wires.

The first spiral antenna arm can include coaxial first and second spirals, and the second spiral antenna arm can include coaxial third and fourth spirals, with the antenna further comprising: a first dielectric sheet having the first spiral formed on a first side thereof and the second spiral formed on a second side thereof; a first balun formed on the first side of the first dielectric sheet extending from an edge of the first dielectric sheet to the center of the first spiral; first feed means for feeding the first balun and an end of the second spiral; a second dielectric sheet having the third spiral formed on a first side thereof and the fourth spiral formed on a second side thereof; a second balun formed on the first side of the second dielectric sheet extending from an edge of the second dielectric sheet to the center of the third spiral; and second feed means for feeding the second balun and an end of the fourth spiral.

The shapes of each spiral of the first and second spiral antenna arms are defined by:

$$F_1 = r_0 e^{a\phi}, \text{ where } a = 1 = \tan 45°; \text{ and}$$

$$F_2 = r_0 e^{b\phi}, \text{ where } b = -1 = \tan(-45°)$$

The shape of the at least one sheet of dielectric material may be planar, or the shape of the at least one sheet of dielectric material may be conical, or the shape of the at least one sheet of dielectric material can be pyramidal.

Preferably, the first and second spirals are non-overlapping relative to the axial direction of the spirals, and the third and fourth spirals are non-overlapping relative to the axial direction of the spirals. Further, the orientations of the first spiral antenna arm and the second spiral antenna arm can be selected so that overlapping between the first and second spiral antenna arms is minimal relative to directions of signals to be transmitted and received.

Additionally, it is preferable that the first and second antenna arms are separated by a maximum of one wave length of a signal to be transmitted and received and are electrically separated. Further, the antenna can be a broadband antenna which receives and transmits right-hand and left-hand circularly polarized signals.

The present invention will now be described with reference to the following drawings, in which like reference numbers denote like elements throughout.

DESCRIPTION OF THE PREFERRED EMBODIMENTS

Figure 1B:
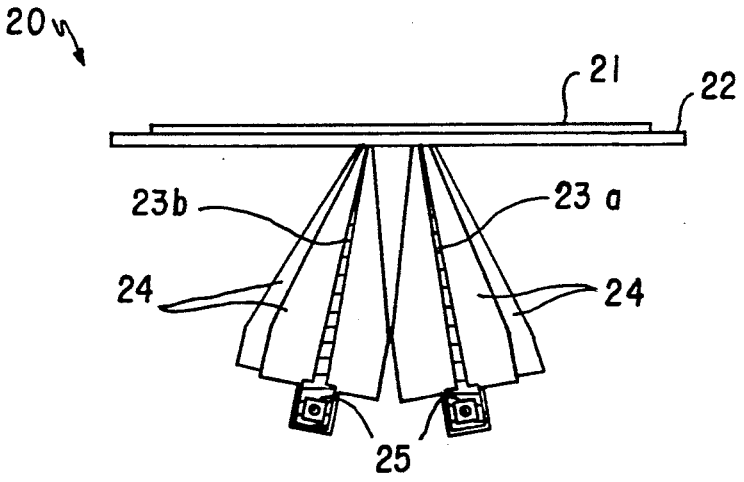
FIG. 1B PRIOR ART
FIG. 1B is a side view of the prior art sinuous antenna illustrated in FIG. 1A.
Figure 1A:
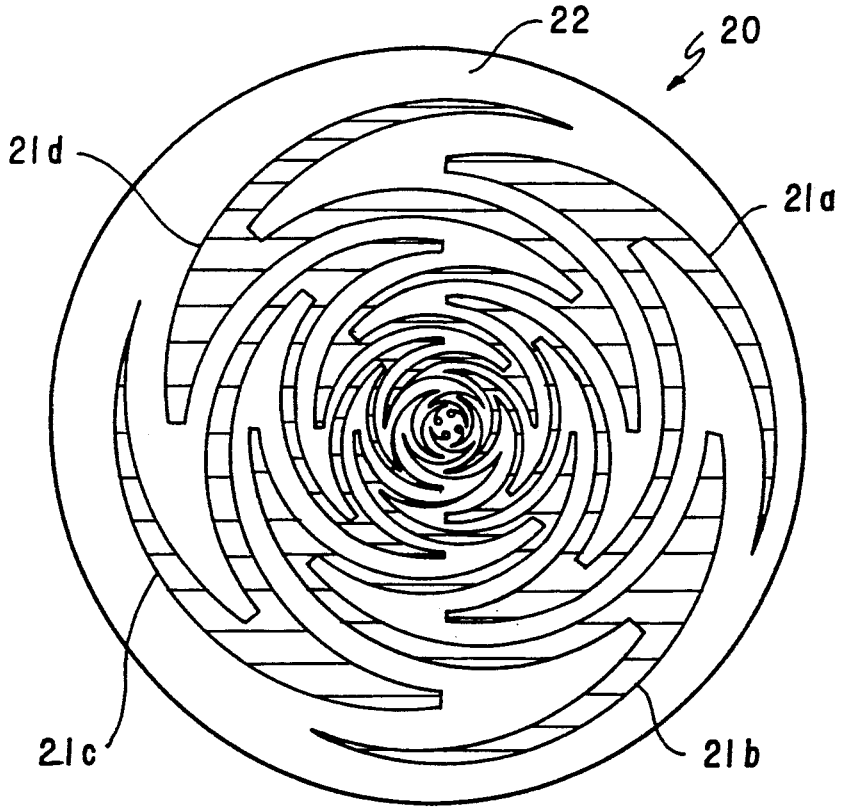
FIG. 1A PRIOR ART
FIG. 1A is a top view of a prior art sinuous antenna.

Reference will be made in detail to the present preferred embodiments of the invention, examples of which are illustrated in the accompanying drawings after discussing a prior art antenna, which is illustrated in FIGS. 1A and 1B.

FIG. 1A is a top view of a sinuous antenna which has both broadband and dual polarization characteristics. The sinuous antenna is a recent development, and has been presented as a breakthrough in the field of broadband dual polarized antennas.

A sinuous antenna 20 illustrated in FIG. 1A comprises four identical sinuous arms 21*a*, 21*b*, 21*c*, 21*d*, which are formed on a substrate 22. The antenna arms 21*a*, 21*b*, 21*c*, 21*d* must be center fed, and, in addition, like any antenna element, each of the antenna arms 21*a*, 21*b*, 21*c*, 21*d* must be fed in a balanced form. Conventionally, this is accomplished by using baluns to feed antenna elements. In the sinuous antenna 20, the antenna arms 21*a*, 21*b*, 21*c*, 21*d* are conventionally fed from beneath the substrate 22 by respective baluns, only two of which are illustrated for ease of illustration baluns 23*a*, 23*b*, 23*c*, 23*d*, respectively. Baluns 23*a* and 23*b* are formed on respective dielectric strips 24, and connect their respective antenna arms 21*a*, 21*b*, 21*c*, 21*d* to respective connectors 25 (two of which are illustrated), which connect the baluns to coaxial cables (not shown).

As can be appreciated from FIG. 1B, the resulting sinuous antenna is awkward and difficult to manufacture. In this four-arm antenna, four feeds extend through the substrate in close proximity, and the four baluns must extend to the four feeds without the possibility of electrically cross connecting. When more than four antenna arms are utilized, the problem and degree of difficulty for manufacturing are increased.

The present invention has achieved a broadband dual polarized antenna having a much simpler construction than prior art antennas such as sinuous antennas. It is known that spiral antennas provide broadband characteristics. However, the inventor has discovered that by forming a structure having stacked spiral antenna elements in which the spirals have the opposite sense from each other and are orthogonal to each other, a broadband dual polarized antenna will result.

Figure 2B:
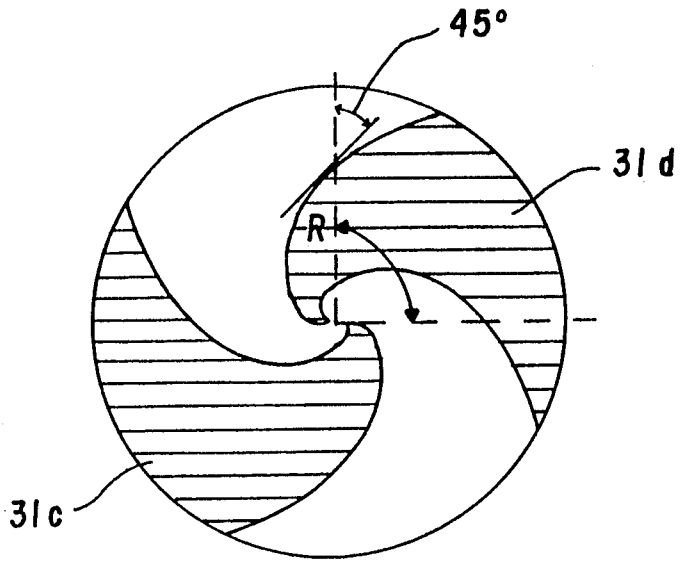
FIG. 2B illustrates a second spiral having a second sense which fulfills the design requirements for a second spiral in accordance with the present invention.
Figure 2A:
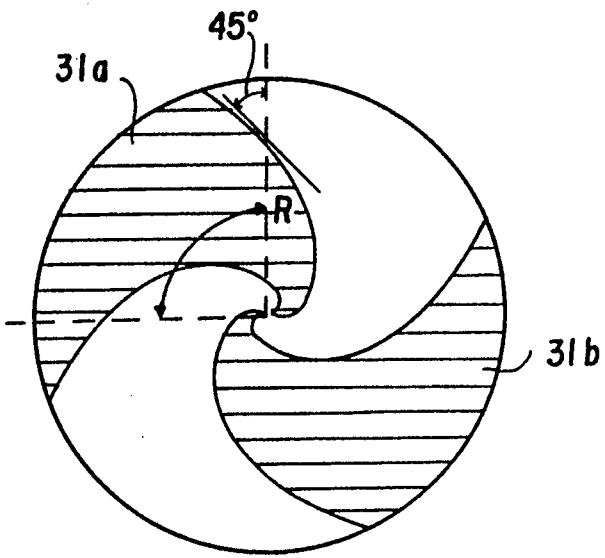
FIG. 2A illustrates a first spiral having a first sense which fulfills the design requirements for a first spiral in accordance with the present invention.

The requirements for a first spiral of such an antenna can be described relative to FIG. 2A. FIG. 2A generally illustrates a pair of spiral antenna arms 31*a*, 31*b*. The spiral antenna arms 31*a*, 31*b* are metallizations or conductive elements which are formed, etched or mounted on a substrate 32 by conventional means. Each of the spiral antenna arms 31*a*, 31*b* is an equiangular logarithmic spiral which has the form $$R=e^{k\phi}$$

where R is the radius vector from the origin to a point on the curve, $\phi$ is the angle of rotation, and k is a constant defining the rate of expansion of the spiral.

In order for an antenna to receive and transmit dual polarized signals, orthogonality is necessary. As mentioned above, the inventor has found that by making stacked antenna elements orthogonal to each other, a dual polarized antenna would result. Accordingly, identical spiral elements having opposite senses and spiral angles (rates of expansion) of 45° which are stacked coaxially are orthogonal to each other. A pair of equiangular logarithmic spiral antenna arms 31*c*, 31*d* having the sense opposite to that of the spiral antenna arms 31*a*, 31*b* is illustrated in FIG. 2B. Therefore, in order to obtain orthogonality between the oppositely-sensed pairs of arms, the first pair of arms must conform to the equation:

$$F_1=r_0e^{a\phi}, \text{ where } a=1=\tan 45^\circ$$

while the second pair of arms must conform to the equation:

$$F_2 = r_o e^{b\phi}, \text{ where } b = 1 = \tan(-45°)$$

The angle of rotation $\phi$ for the spiral arms can be different in different antennas.

Figure 3A:
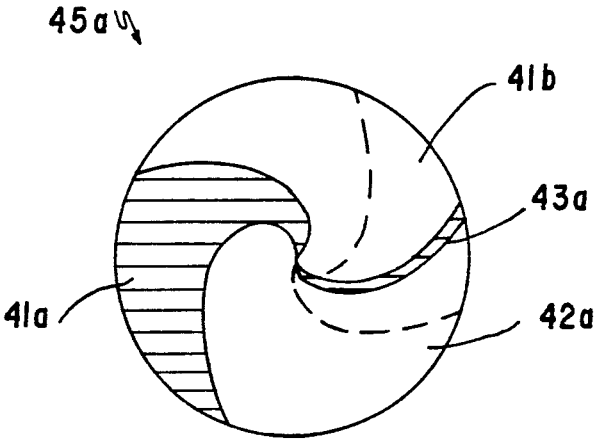
FIG. 3A is a top view, partially in cross section, of a portion of an antenna for detecting one polarization according to a first embodiment of the present invention.

A first embodiment of the present invention will now be described with respect to FIGS. 3A, 3B and 3C. FIG. 3A is a top view, partially in cross section, of a pair of equiangular logarithmic spiral antenna arms 41*a*, 41*b* having the same sense which constitute a first portion 45*a* of an antenna 40. The first spiral antenna arm 41*a* is preferably a conductive material or metallization, and is etched or formed on a first side of a substrate 42*a*, which in the preferred embodiment has a two-dimensional shape and may be a planar sheet of dielectric material. The first spiral antenna arm 41*a* is fed via a balun 43*a*. The balun 43*a* can be an integrated balun, and can be a metallization formed or etched on the first side of the substrate 42*a*. The balun 43*a* leads from an edge of the substrate 42*a* to provide a balanced center feed for the first spiral antenna arm 41*a*.

The second spiral antenna arm 41*b*, also preferably a conductive material, is formed or etched on the opposite side of the substrate 42*a* from the first spiral antenna arm 41*a*. The second spiral antenna arm 41*b* should not overlap the first spiral antenna arm 41*a*. It is preferred that the second spiral antenna arm 41*b* be located on the second surface of the substrate 42*a* beneath the balun 43*a* such that the edge of the balun 43*a* and the second spiral antenna arm 41*b* at the edge of the substrate 42*a* are in close proximity. In this way, a common feed 46*a* can be used for feeding both the second spiral antenna arm 41*b* at the edge of the substrate 42*a* and the first spiral antenna arm 41*a* via the balun 43*a*. The feed 46*a* leads to a coaxial connector 47*a* (FIG. 3C).

Figure 3B:
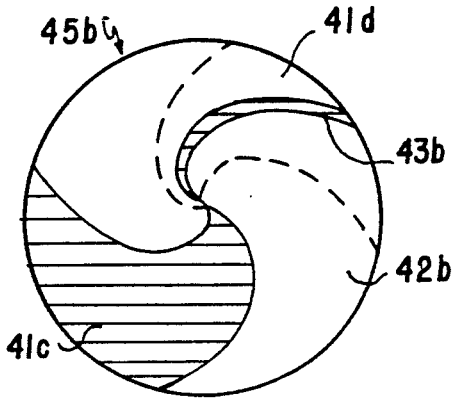
FIG. 3B is a top view, partially in cross section, of a portion of the antenna for detecting a second polarization according to the embodiment of the present invention.

FIG. 3B illustrates a second portion 45*b* of the antenna 40. The second portion 45*b* is nearly identical to first portion 45*a*, the main difference being that third and fourth spiral antenna arms 41*c*, 41*d* of the second portion 45*b* have the opposite sense to the first and second spiral antenna arms 41*a*, 41*b* of the first portion 45*a*. This should provide orthogonality between the pairs of antenna arms. An integrated balun 43*b* center feeds the third spiral antenna arm 41*c*, and a common feed 46*b* feeds both the balun 43*b* and the fourth spiral antenna arm 41*d* at an edge of a second substrate 42*b*.

The first and second portions 45*a*, 45*b* together form the broadband dual polarized antenna 40. The first and second portions 45*a*, 45*b* are stacked such that the four spiral antenna arms 41*a*, 41*b*, 41*c*, 41*d* are all coaxial, as illustrated in FIG. 3C. Radiation is transmitted from and received by the antenna 40 in the directions generally illustrated by the arrows in FIG. 3C. It is preferred that the distance between the oppositely sensed antenna arms is no greater than one wavelength of a signal to be transmitted and received therefrom. The oppositely sensed spiral antenna arms should not contact each other, and overlap relative to the directions of signals to be transmitted and received should be kept to a minimum.

Figure 3C:
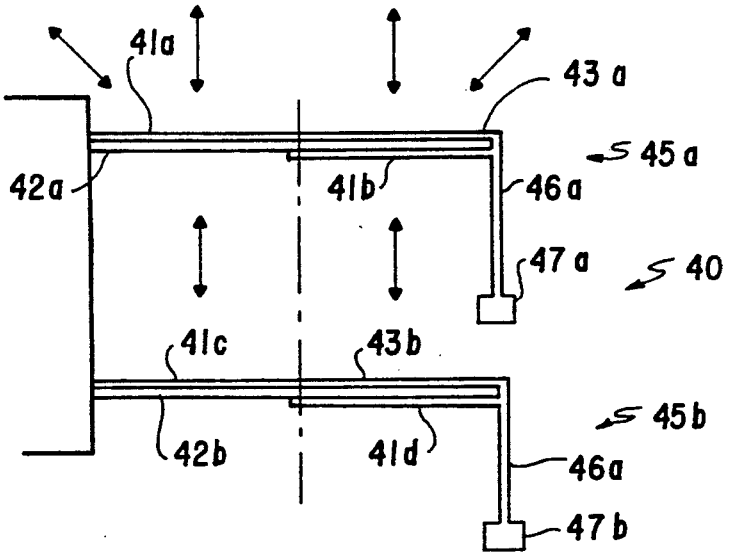
FIG. 3C is a side view of the first embodiment of the present invention which includes the antenna portions illustrated in FIGS. 3A and 3B.
Figure 4:
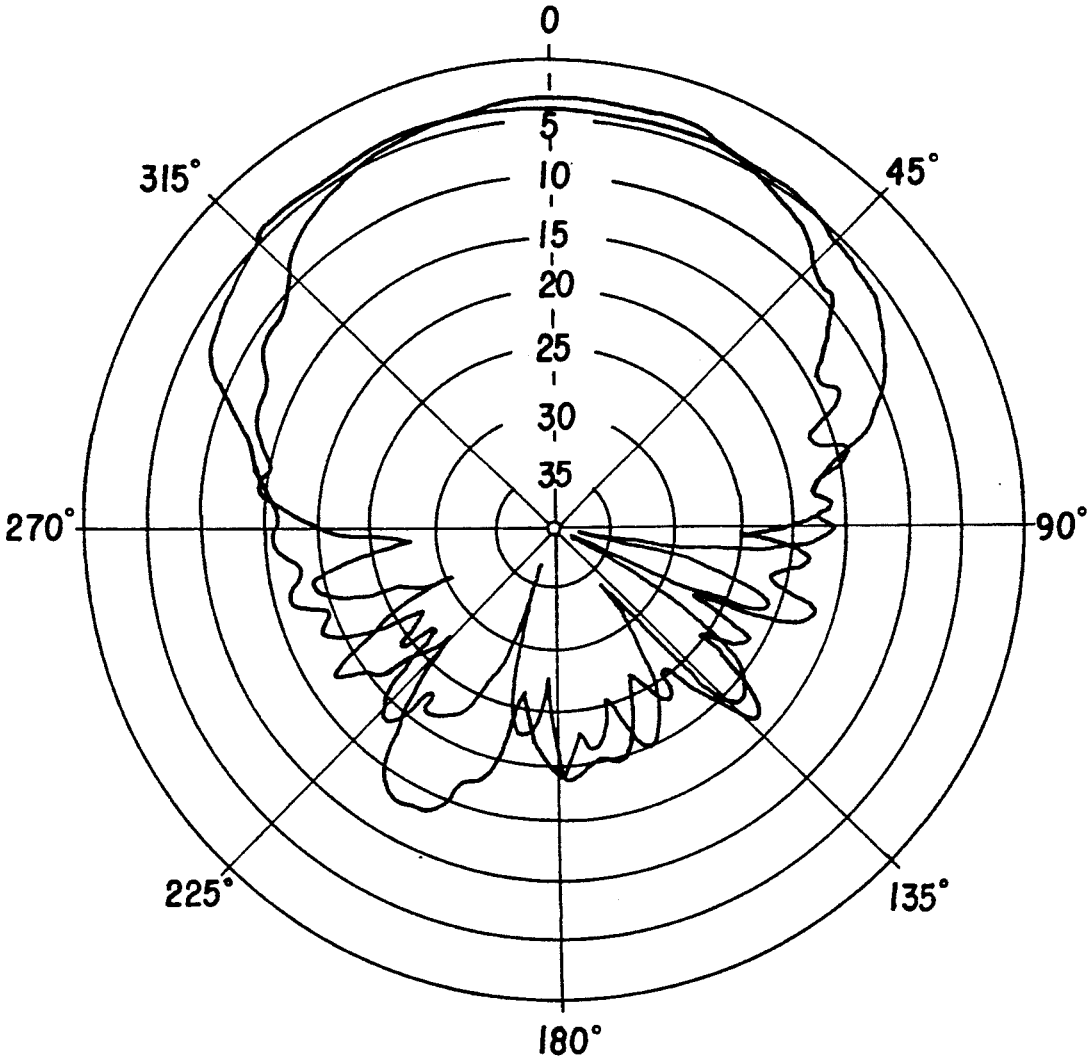
FIG. 4 shows the measured radiation pattern of the stacked double spiral pair antenna of FIG. 3C.

FIG. 4 shows a measured radiation pattern of the stacked double spiral pair antenna of FIG. 3C at 8.0 GHZ. The radiation pattern shows that an exceptionally good pattern is developed for more than 50° in any direction from the axis of the antenna. In most applications, the antenna of the present invention would be a forward-looking antenna, and would be forward mounted on its platform. In most such cases, an antenna need only be effective for 45° in any direction from its axis. Accordingly, the double spiral antenna provided by the present invention more than meets the minimum requirements for its primary intended use.

Figure 5A:
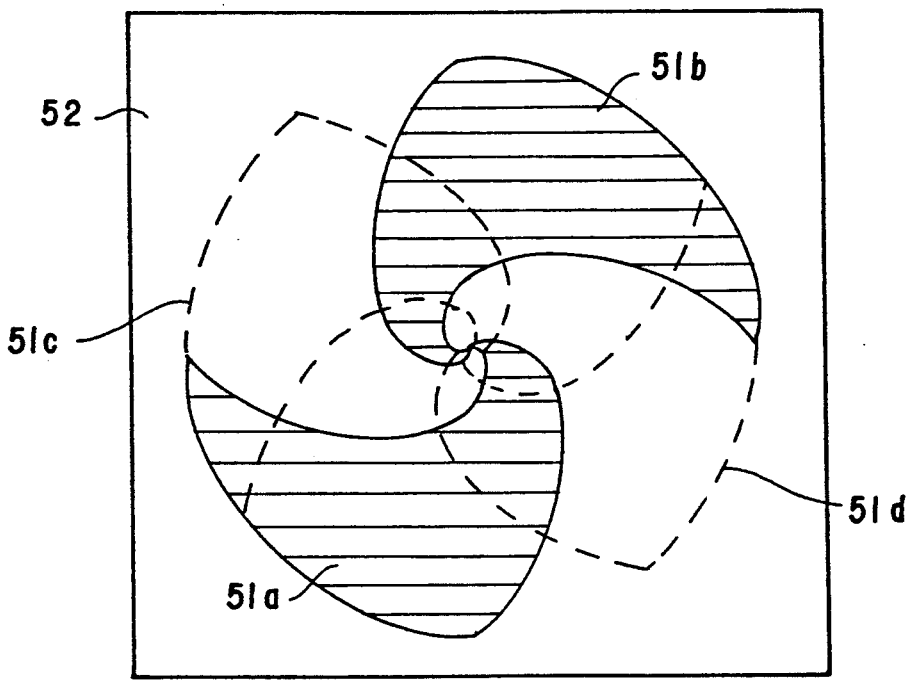
FIG. 5A is a top view, partially in cross section, of two pair of oppositely sensed edge-fed spiral antenna arms according to a second embodiment of the present invention.
Figure 5B:
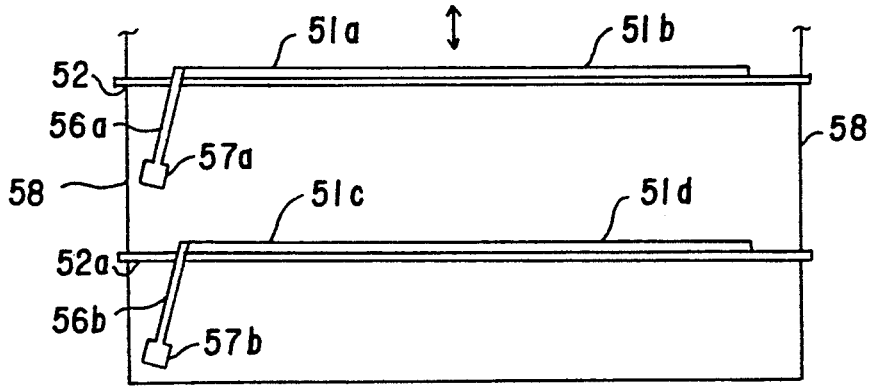
FIG. 5B is a side view of a first antenna structure composed of the antenna arms of FIG. 5A.
Figure 5C:
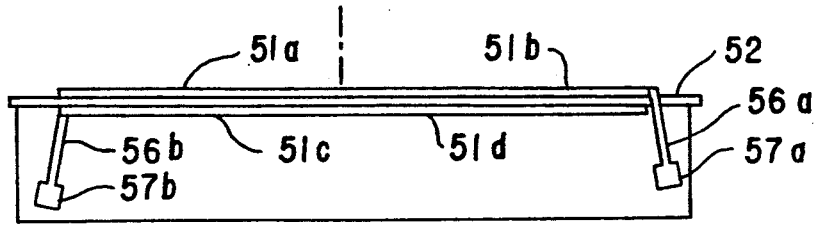
FIG. 5C is a side view of a second antenna structure composed of the antenna arms of FIG. 5A.

A second embodiment of an antenna according to the present invention will now be described with reference to FIGS. 5A, 5B and 5C. FIG. 5A is a top view, partially in cross-section, of an edge-fed double spiral antenna having two pair of oppositely-sensed spiral antenna arms. A first pair of spiral antenna arms 51*a*, 51*b* are formed or etched onto a surface of a substrate 52. The first and second spiral antenna arms 51*a*, 51*b* are preferably a conductive material and are equiangular logarithmic spirals having an expansion rate of 45°. A second pair of identical spiral antenna arms 51*c*, 51*d* are formed coaxial to the first pair. The second pair of spiral antenna arms 51*c*, 51*d* can be mounted or etched onto the surface of a second substrate 52*a*, as illustrated in FIG. 5B, or can be formed or etched into the second side of the same substrate 52 as the first pair of spiral antenna arms 51*a*, 51*b*, as illustrated in FIG. 5C. The first pair of spiral antenna arms 51*a*, 51*b* are edge fed at an edge of one of the arms 51*a*, 51*b* by a single feed 56*a*, which leads to a coaxial connector 57*a*. The second pair of spiral antenna arms 51*c*, 51*d* are edge fed at an edge of one of the arms 51*c*, 51*d* by a single feed 56*b*, which leads to a coaxial connector 57*b*.

The substrates 52, 52*a* of FIG. 5B and the substrate 52 of FIG. 5C are held in place in a structure 58, which may be shaped so that the antenna is cavity backed, as illustrated in FIG. 5B.

Figure 6A:
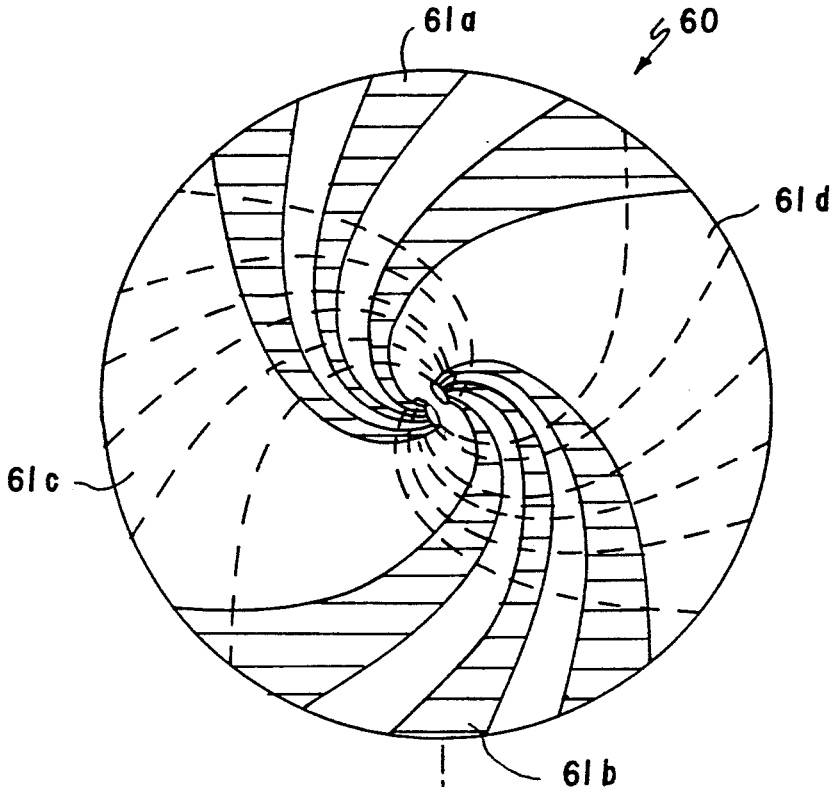
FIG. 6A is a top view, partially in cross section, of two pair of segmented oppositely sensed center-fed spiral antenna arms according to a third embodiment of the present invention.

A third embodiment of the present invention will now be described with reference to FIG. 6A. In the third embodiment of the present invention, each spiral antenna arm is segmented. That is, each spiral antenna arm 61*a*, 61*b*, 61*c*, 61*d* comprises a number of segments, each of which is an equiangular logarithmic spiral having an expansion rate of 45°. This segmenting of the arms reduces the overlap between the stacked antenna arms relative to signals to be received and transmitted by the antenna, and thereby increases the isolation between the sets of stacked arms of the antenna.

Figure 6B:
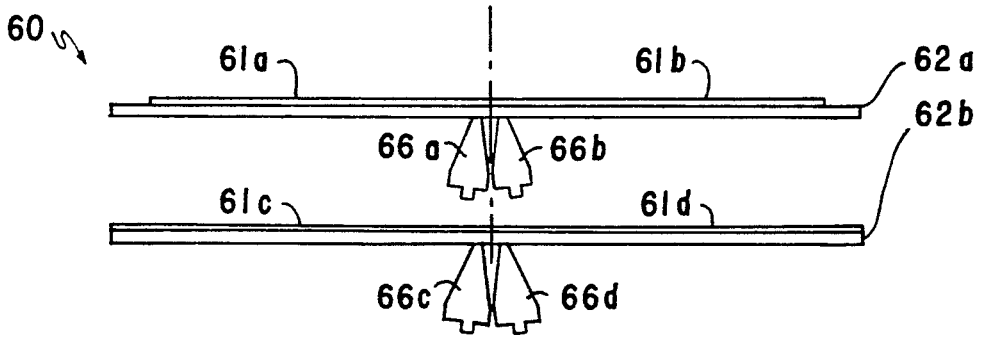
FIG. 6B is a side view of a first antenna structure which includes the antenna arms of FIG. 6A.

A first preferred structure of this embodiment is illustrated by FIG. 6B. A top layer of the antenna 60 includes the first and second coaxial spiral antenna arms 61*a*, 61*b*, which are conductive materials formed or etched on a substrate 62*a*. Each of the spiral antenna arms 61*a*, 61*b* consists of three segments which have a common central point at which they are center fed by conventional center feed means 66*a*, 66*b*, respectively, through the substrate 62*a*.

Also illustrated in FIG. 6B is the bottom layer of the antenna 60, which includes a pair of segmented spiral antenna arms 61*c*, 61*d* which are coaxial with and have the opposite sense to the antenna arms 61*a*, 61*b*. The antenna arms 61*c*, 61*d* are formed or etched on a substrate 62*b*. Each of the bottom layer spiral antenna arms 61*c*, 61*d* comprise three spiral segments having a common center point, at which they are center fed by feed means 66*c*, 66*d*, respectively.

Figure 6C:
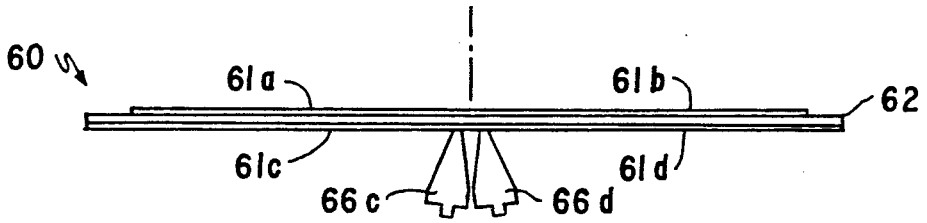
FIG. 6C is a side view of a second antenna structure which includes the antenna arms of FIG. 6A.

A second preferred structure of a segmented dual spiral antenna is illustrated by FIG. 6C. In FIG. 6C, two pairs of oppositely-sensed, coaxial spiral antenna arms 61*a*, 61*b* and 61*c*, 61*d* are formed or etched on opposite sides of a single substrate. All four spiral antenna arms 61*a*, 61*b*, 61*c*, 61*d* are center fed by respective feed means, only two of which are depicted in FIG. 6C. The segmented spiral antenna arm 61c is center fed by feed means 66c, and the segmented antenna arm 61d is center fed by feed means 66d.

Figure 7A:
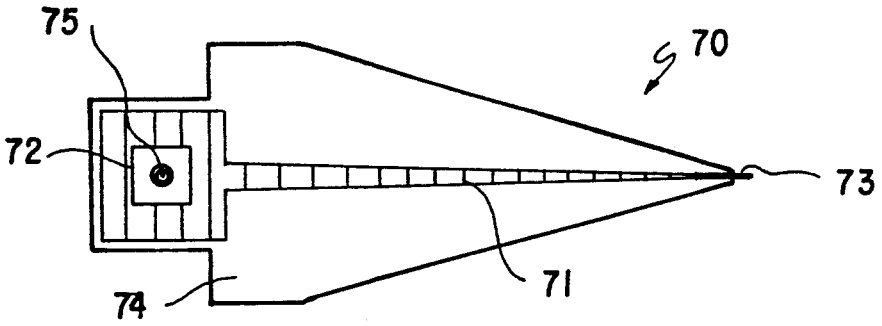
FIG. 7A is a top view of a tapered balun.
Figure 7B:
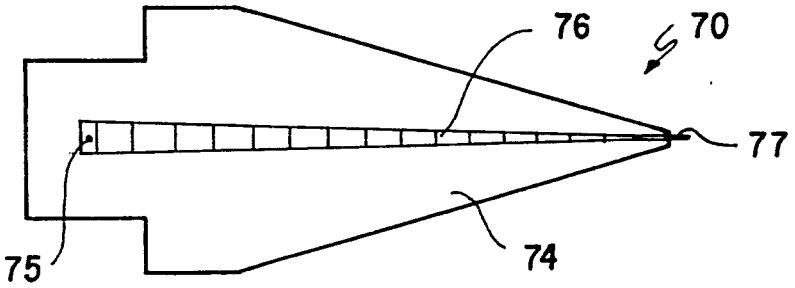
FIG. 7B is a bottom view of the tapered balun of FIG. 7A.

Preferably, the center feed means for each of the spiral metallizations 61a, 61b, 61c, 61d includes a conventional wideband balun which utilizes a tapered transmission line. Such a balun is illustrated by FIGS. 7A and 7B. The wideband balun 70 gradually converts, in cross-sectional characteristics, from an unbalanced feedline, such as a coaxial cable at a first impedance, to a balanced line at a second impedance at the other end. A first side of the wideband balun 70 is illustrated by FIG. 7A. The wideband balun 70 includes a first tapered transmission line 71 which balances the outer conductor of a coaxial cable (not shown) connected to a coaxial connector 72. The first tapered transmission line 71 feeds into a first balanced feed line 73. The tapered transmission line 71 can be formed or etched onto a substrate 74.

A second tapered transmission line 76 balances the inner conductor of the coaxial cable. An inner conductor connector 75 of the coaxial connector 72 extends through the substrate 74 to a first end of the second tapered transmission line 76. A second balanced line 77 leads from a second end of the second tapered transmission line 76.

Figure 8:
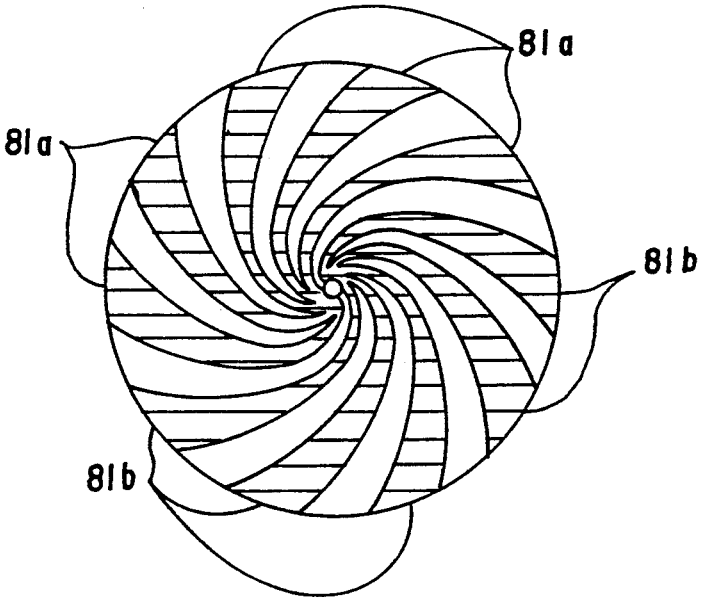
FIG. 8 is a top view of a pair of center-fed spiral antenna arms having a plurality of segments.

The segmented spiral antenna is by no means limited to spiral antenna arms having three segments each. As illustrated in FIG. 8, a pair of equiangular logarithmic spiral antenna arms 81a, 81b are composed of five segments each. The number of segments is not a limitation; rather, each segment of a spiral arm must be an equiangular logarithmic spiral so that each segment will be orthogonal to segments having the opposite sense which are associated with the second pair of spiral antenna arms.

Figure 9:
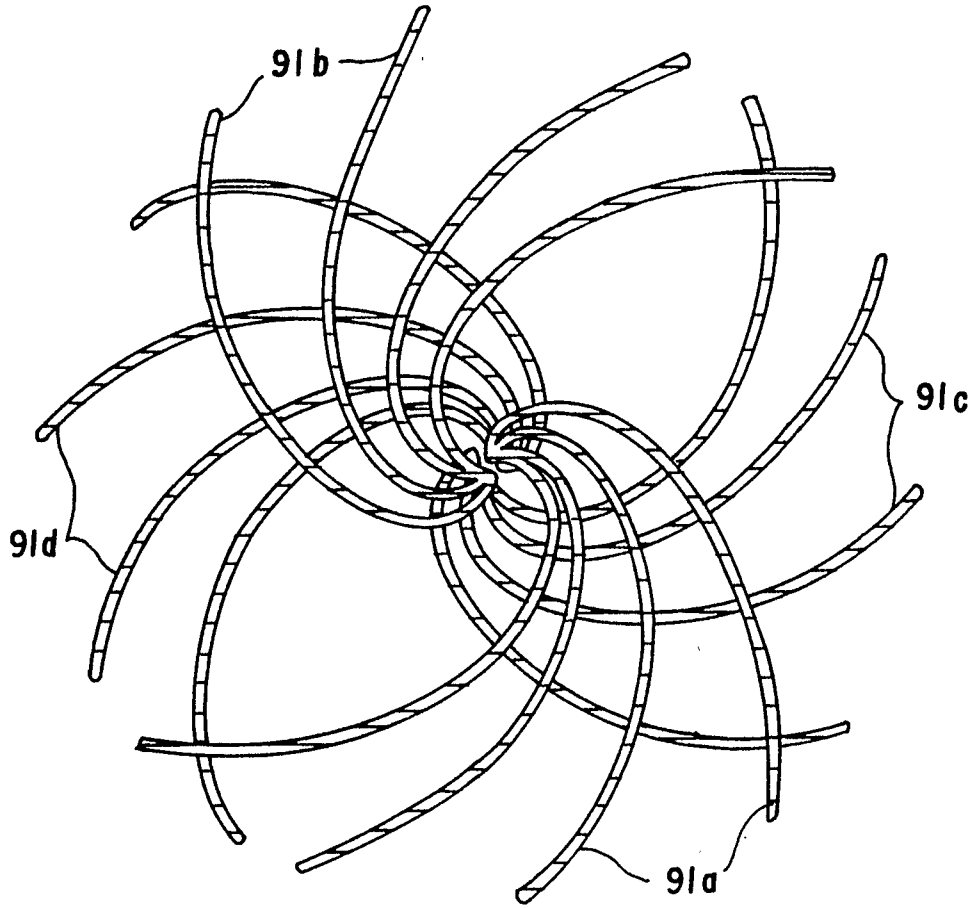
FIG. 9 is a schematic top view of two pair of center-fed oppositely sensed spiral antenna arms composed of a plurality of wires or thin segments.

FIG. 9 is a schematic top view of two pair of oppositely sensed spiral antenna arms 91a, 91b, 91c, 91d in which each spiral arm includes a plurality of spiralling conductive wires or strip elements. Each wire or strip element in each spiral arm is an equiangular logarithmic spiral, and each wire or strip element is orthogonal to each wire or strip element in the oppositely-sensed spiral arms. By forming two pair of antenna arms with wires or strip elements, overlap between the two pair of spiral antenna arms relative to signals to be transmitted and received is kept to a minimum, and thus interference between the two pairs of spiral antenna arms should be minimal. Further, the amount of conductive material used is also minimal, which could improve the low observability characteristic of the antenna. Like the segmented antennas of FIGS. 6B and 6C, the wire or strip element antenna of FIG. 9 can comprise wires or strip elements that are mounted, formed or etched onto either side of a single substrate or onto one side of each side of two substrates. The spiral arms 91a, 91b, 91c, 91d are coaxial, and the wires or strip elements of each spiral arm have a common center point at which they are center fed, preferably with a strip balun of the type illustrated in FIGS. 7A and 7B.

The embodiments of the present invention discussed above have been illustrated respective to a planar substrate. However, all of the above discussed embodiments can be formed or etched onto three-dimensional substrates, such as conical or pyramidal substrates, as illustrated in FIGS. 10A and 10B and FIGS. 11A and 11B, respectively. The basic requirements for the antenna as discussed above must be maintained. That is, two pair of logarithmic equiangular spirals having opposite senses must be formed coaxially such that there is orthogonality between the pairs.

Figure 10A:
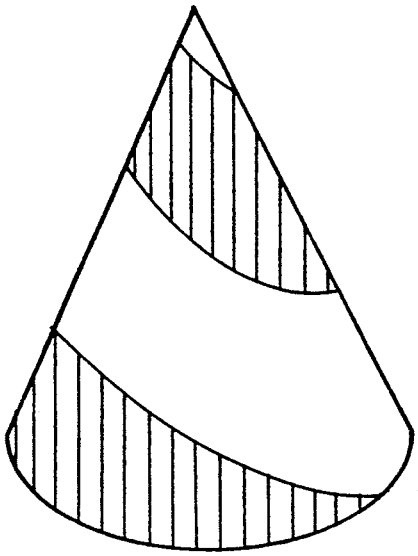
FIG. 10A is a perspective view of a conical spiral antenna according to the present invention.
Figure 10B:
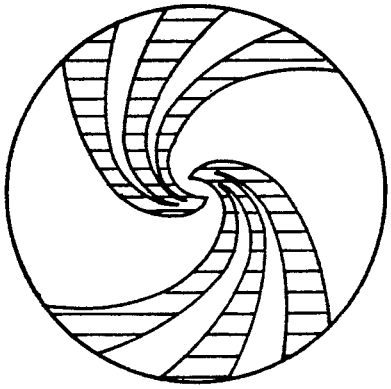
FIG. 10B is a top view of the conical spiral antenna of FIG. 10A.

Conical spiral antennas have been conventionally employed to obtain unidirectional patterns without the use of a cavity or a reflector. Like antennas formed on planar substrates, antennas formed on conical substrates will also provide frequency-independent wideband performance. A perspective view of a pair of logarithmic equiangular spirals mounted on a cone is provided by FIG. 10A, and FIG. 10B is a top view of such a conical antenna.

Figure 11A:
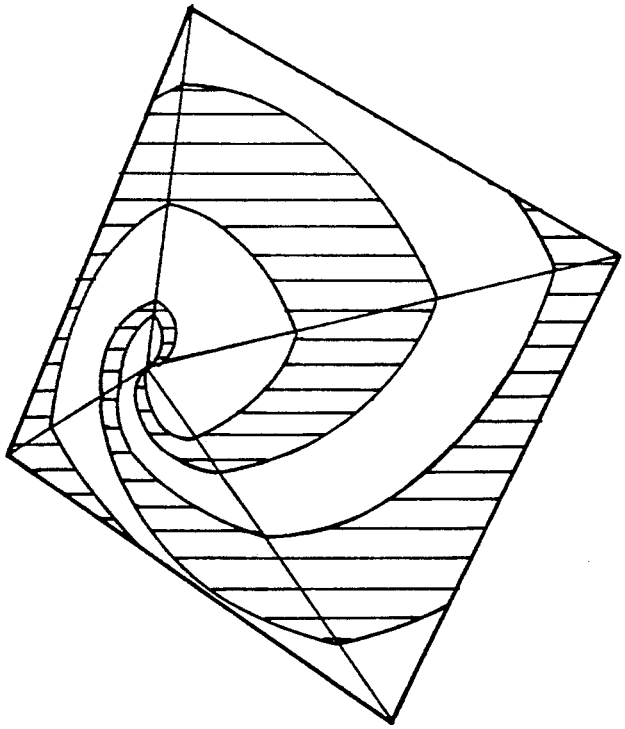
FIG. 11A is a perspective view of a pair of spiral antenna arms formed on a pyramidal substrate according to the present invention.
Figure 11B:
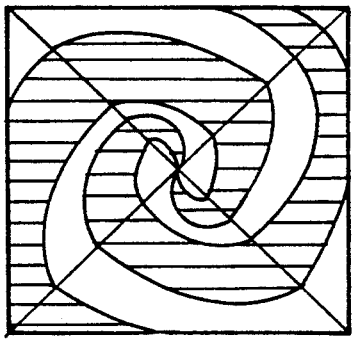
FIG. 11B is a top view of the pyramidal substrate having the antenna arms formed thereon illustrated in FIG. 11A.

Similarly, frequency-independent performance can be obtained by forming spirals on a substrate having the shape of a square pyramid with a half angle of 45°, as illustrated in perspective in FIG. 11A and in a top view in FIG. 11B. Depending on the type of spiral arm chosen, the spiral arms can be either center fed or edge fed, as discussed with respect to FIGS. 2–8.

Figure 12:
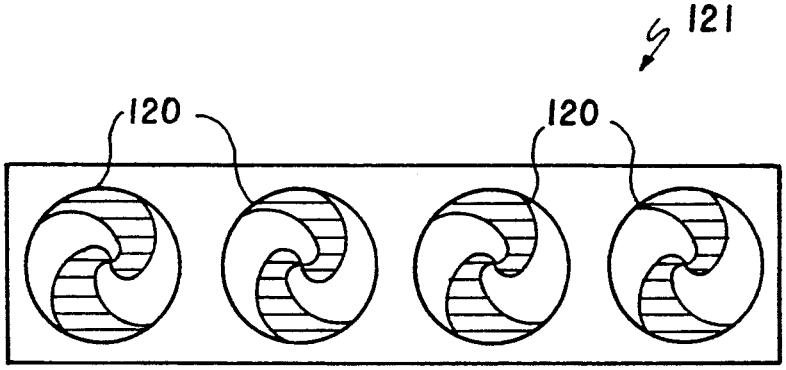
FIG. 12 illustrates a plurality of antennas arranged in an array.

A plurality of antennas 120 can be arranged in an array 121, as illustrated in FIG. 12. The configuration of the array depends on the desired radiation field pattern. For example, the antennas can be arranged in a phased array in order to permit beam shaping and scanning.

While several embodiments of the invention have been discussed, it will be appreciated by those skilled in the art that various modifications and variations are possible without departing from the spirit and scope of the invention.

I claim:

1. An antenna comprising;

a first spiral antenna arm including coaxial first and second equiangular spirals, each spiraling in a clockwise manner about a central axis when viewed from a top side;

a second spiral antenna arm including coaxial third and fourth equiangular spirals, each spiraling in a counterclockwise manner about the central axis when viewed from said top side;

a first dielectric sheet having the first spiral formed on a first side thereof and the second spiral formed on a second side thereof;

a first balun formed on the first side of said first dielectric sheet extending from an edge of said first dielectric sheet to the center of said first spiral in opposing relation to the second spiral;

first feed means for feeding said first balun and an end of the second spiral;

a second dielectric sheet having the third spiral formed on a first side thereof and the fourth spiral formed on a second side thereof;

a second balun formed on the first side of said second dielectric sheet extending from an edge of said second dielectric sheet to the center of the third spiral in opposing relation to the fourth spiral; and second feed means for feeding said second balun and an end of the fourth spiral.

2. An antenna according to claim 1, wherein said first and second spirals of said first spiral antenna arm are each defined by:

$r_0e^{a\phi}$, where $r_0$ is the beginning radius, a is the rate of expansion and $\phi$ is the angle of rotation, and $a=1=\tan 45°$; and said first and second spirals of said second spiral antenna are each defined by:

$r_0e^{a\phi}$, where $r_0$ is the beginning radius, b is the rate of expansion and $\phi$ is the angle of rotation, and $b=-1 \tan(-45°)$.

3. An antenna according to claim 1, wherein each of said first and second dielectric sheets has a three-dimensional shape.

4. An antenna according to claim 1, wherein each of said first and second dielectric sheets is conical.

5. An antenna according to claim 1, wherein each of said first and second dielectric sheets is pyramidal.

6. An antenna according to claim 1, wherein the first and second spirals are substantially non-overlapping and the third and fourth spirals are substantially non-overlapping, relative to an axial direction of the spirals.

7. An antenna according to claim 5, wherein said first spiral antenna arm and said second spiral antenna arm are formed so that overlapping between said first and second spiral antenna arms is minimal relative to directions of signals to be transmitted and received by the antenna.

8. An antenna comprising:

a first dielectric sheet having a first spiral antenna arm mounted thereon, the first spiral antenna arm including a first spiral mounted on a top side of the first dielectric sheet and a second spiral mounted on a bottom side of the first dielectric sheet;

a second dielectric sheet spaced from said first dielectric sheet and having a second spiral antenna arm mounted thereon, the second spiral antenna arm including a first spiral mounted on a top side of the second dielectric sheet and a second spiral mounted on a bottom side of the second dielectric sheet;

wherein said first and second spiral antenna arms spiral about a common axis and have opposite spiral senses relative thereto, wherein said first spiral antenna arm spirals in a clockwise manner when viewed from a top side and said second spiral antenna arm spirals in a counterclockwise manner when viewed from said top side;

first feed means interconnected to said first spiral antenna arm, including a balun formed on said top side of said first dielectric sheet for center feeding said first spiral of said first spiral antenna arm; and second feed means, separate from said first feed means, interconnected to said second spiral antenna arm, including a balun formed on said top side of said second dielectric sheet for center feeding said first spiral of said second spiral antenna arm.

9. An antenna according to claim 8, wherein said first and second spirals of said first spiral antenna arm are each defined by:

$r_0e^{a\phi}$, where $r_0$ is the beginning radius, a is the rate of expansion and $\phi$ is the angle of rotation, and $a=1=\tan 45°$; and said first and second spirals of said second spiral antenna are each defined by:

$r_0e^{a\phi}$, where $r_0$ is the beginning radius, b is the rate of expansion and $\phi$ is the angle of rotation, and $b=-1 \tan(-45°)$.

10. An antenna according to claim 8, wherein each of said first and second dielectric sheets is planar.

11. An antenna according to claim 8, wherein each of said first and second dielectric sheets is conical.

12. An antenna according to claim 8, wherein each of said first and second dielectric sheets is pyramidal.

13. An antenna according to claim 8, wherein the first and second spirals of said first and second spiral antenna arms are substantially non-overlapping.

14. An antenna according to claim 8, wherein said first and second spiral antenna arms are formed on said dielectric sheets so that overlap between said arms relative to directions of signals to be transmitted and received is minimized.

15. An antenna according to claim 8, wherein said antenna transmits and receives right-hand and left-hand circularly polarized broadband signals.

16. An antenna according to claim 8, wherein said first and second antenna arms are separated by a maximum of one wavelength of a signal to be transmitted and received.

* * * * *